United States Patent [19]

Decker

[11] Patent Number: 4,646,440

[45] Date of Patent: Mar. 3, 1987

[54] REPLACEABLE BLADE KNIFE

[76] Inventor: John R. Decker, 5710 Harder St., San Jose, Calif. 95129

[21] Appl. No.: 615,922

[22] Filed: May 31, 1984

[51] Int. Cl.[4] ..... B26B 1/08

[52] U.S. Cl. ..... 30/339; 30/335; 30/351

[58] Field of Search ..... 30/336, 339, 162, 320, 30/335, 337, 338, 334, 351; D8/20

[56] References Cited

U.S. PATENT DOCUMENTS

| | | | |
|---|---|---|---|
| 1,754,650 | 4/1930 | Seaholm | 30/337 X |
| 2,018,603 | 10/1935 | Case et al. | 30/337 X |
| 2,413,082 | 12/1946 | Skaer | 30/337 X |
| 2,431,118 | 11/1947 | Heigle | 30/339 X |
| 3,063,147 | 11/1962 | Paparelli | 30/320 X |
| 3,171,201 | 3/1965 | Carifi | 30/335 |
| 3,314,148 | 4/1967 | Foellmi | 30/162 |
| 3,708,881 | 1/1973 | Bennett | 30/320 |
| 3,889,368 | 6/1975 | Himeno | 30/335 X |
| 3,905,101 | 9/1975 | Shepherd | 30/339 |
| 4,196,515 | 4/1980 | Sugiyama | 30/162 |

OTHER PUBLICATIONS

American Safety Razor, Co., Graphic Art Blades, p. A17, Feb. 1, 1977.

*Primary Examiner*—Jimmy C. Peters

*Attorney, Agent, or Firm*—Townsend and Townsend

[57] ABSTRACT

A low profile precision knife with a quick-change or safety storable blade. The blade holding handle being stamp formed from a minimum of two parts, namely a metal spring slide and a metal housing. The spring slide adapted to slidably fit the housing is provided with a flexible tang that is receivable to an aperture in the blade's shank. Securement of the blade is made by pulling on a projection on the spring slide at the knife handle's rear, thereby causing longitudinal bends and a tang, through the blade's aperture, to exert deformed pressure against the blade shank and an internal projecting nub in the housing when it is brought to its detent position against parallel shoulders on the blade. Removal of the blade is made by pushing forward with a finger on the slide projection at the rear of the knife. The blade can be safety stored by reversing the cutting edge into the housing when the spring slide is fully extended. The flexible tang on the spring slide is receivable to the aperture in the reversed blade and is locked in when the reversed blade shoulders are against the end of the housing. Lifting on the reversed shank of the blade while pushing downward on the flexible tang releases the blade.

11 Claims, 12 Drawing Figures

REPLACEABLE BLADE KNIFE

BACKGROUND OF THE INVENTION

This invention relates generally to cutting tools and specifically to an improved precision cutting knife having a blade that can be positively secured to a handle, is easily replaceable, and is safety storable.

Among commercially available precision knives is a type that employs a small blade that is detachably secured to one end of a five-sixteenth inch by five inch cylindrical, aluminum handle. The blade is inserted into a slotted, tapered chuck and is held secured when the chuck is threaded into the handle through a tapered sleeve. Securing the blade in this type of knife requires the user to hold the blade while turning a sleeve and chuck and then make a determination as to correct tightness. If the blade is not properly tightened, it can become loose during use and cause distortion to the sleeve. Retightening the blade then requires more torque and can be hazardous to the fingers if extra pressure is applied. Additionally, this type of knife has no inherent safety features. Commercially available, add-on plastic safety caps or sleeves, to protect the knife, are expensive, add bulkiness and can be misplaced.

A primary object of the present invention is to provide a knife where removable attachment of the blade to a handle is achieved, primarily, through low profile spring loaded detent pressure exerted directly over an aperture in the blade's shank, and wherein said pressure is safely activated by the user at the end of the handle opposite to the end at which the blade is located.

Another object of the invention is to provide a knife with a blade reversal feature and with detent means allowing the user to safely store the blade in the knife and carry it on his person.

A further object of the invention is to provide a knife of, preferably, stainless spring steel with detent means in cooperation with an aperture in the knife blade wherein the detent means is resiliently self adjustable to compensate for any wear that might occur during use of the knife.

Still a further object of the invention is to provide a knife which is lighter in weight, narrower and thinner than many commercially available, replaceable blade precision knives, thereby allowing for greater versatility when used in various cutting applications.

Another object of the invention is to provide a knife which is simple and rugged in construction, inexpensive to manufacture, and can be used with a novel reversible safety blade or can be used with commercially available blades.

SUMMARY OF THE INVENTION

According to the invention, there is provided a knife having an elongated handle with a narrow channel open at one side near one end; a spring steel blade carrier that is slidably received by the channel and a blade detachably secured to the blade carrier by the cooperating engagement of a projecting, unitarily formed, tab; a receiving aperture in the blade shank; an internally projecting nub from the handle and two laterally projecting shoulders on the knife blade. Uniform bends on the sliding spring steel carrier create a biasing force when the blade shank is centered on the bends and projecting tab, and they are pulled by a thumb on the opposite end by a raised hump in the blade carrier to a coordinated stopping position at the blade shoulders, thereby allowing the carrier resilient tab to exert further pressure as it nests in one side of the blade aperture and against the side of the internal projecting nub.

The biasing force of the slidable spring steel carrier and tab produces a snapping action that is felt by the fingers as the tab is pulled past the internal projecting nub to a detent position in one end of the blade's aperture.

Blade removal is achieved by a forward push of the thumb on a formed hump on the sliding blade carrier located at the opposite end of the knife's handle, thus permitting the blade to fall out, or the blade can be grasped by the fingers and reversed into the handle's housing while the extended sliding carrier's flexible tab snaps into the blade aperture as the blade's shoulders are simultaneously pushed to a stop against the handle housing. The blade, in this safety storable position, is locked in and is removable only through a definite lifting and pulling action by the fingers on the end of the blade's shank, or by pushing inwardly on the resilient tab while simultaneously pulling on the blade shank.

A preferred embodiment of a resilient pocket clip, unitarily attached to the formed hump at the knife's rear, is raised upwardly at its forward end to a receiving position when a tab, protruding inwardly on the clip, is pushed past and out of an elongated aperture in the knife handle. The pocket clip has a biasing force that keeps it closed and horizontally flat against the housing when the attached sliding blade carrier is not fully extended.

A preferred embodiment of a reversibly storable blade is provided with two ends that are of the same width, each end being slidably receivable in the knife handle. An aperture, centered in the blade shank, is adapted to fit the spring tab on the knife carrier. Two parallel, laterally protruding shoulders centered in the blade are coordinated to a detent position against the knife handle when the blade is reversed on the sliding carrier with the spring tab through the blade aperture.

DESCRIPTION OF THE PREFERRED EMBODIMENTS

Figure 1:
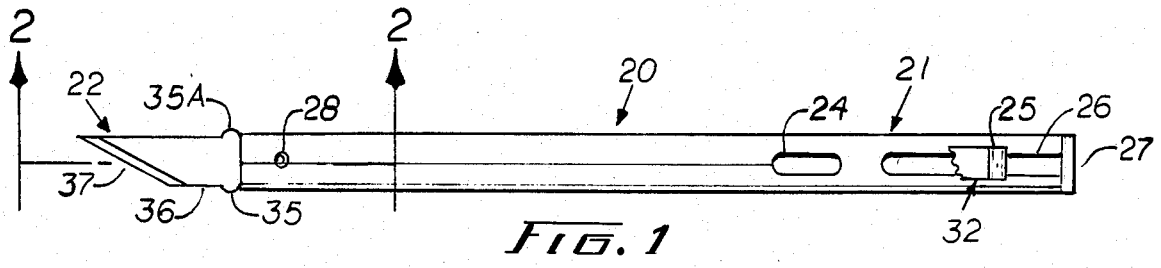
FIG. 1 illustrates a preferred precision knife embodying the invention with the blade installed in its cutting position, a part of a pocket clip being shown cut away in order to reveal the underlying channel and aperture.
Figure 2:
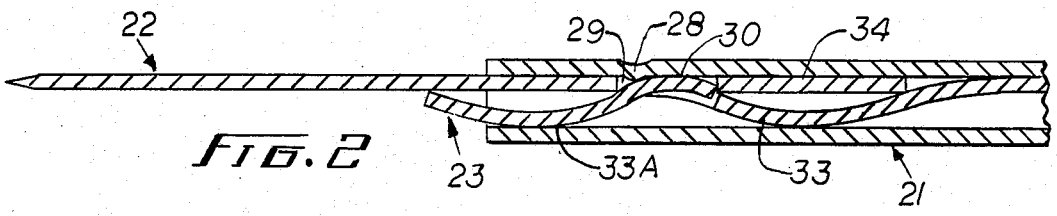
FIG. 2 is an enlarged, sectional view taken along line 2—2 of FIG. 1.
Figure 3:
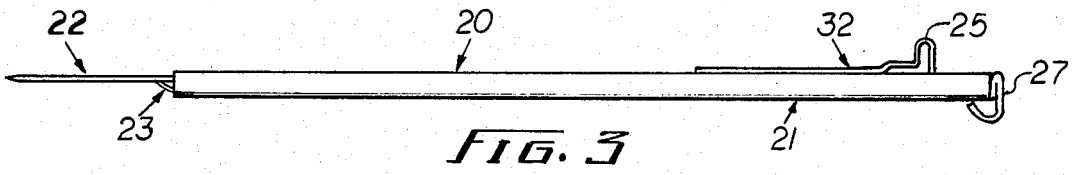
FIG. 3 is an elevational side view of the knife of FIG. 1, showing the pocket clip fully in place.
Figure 4:
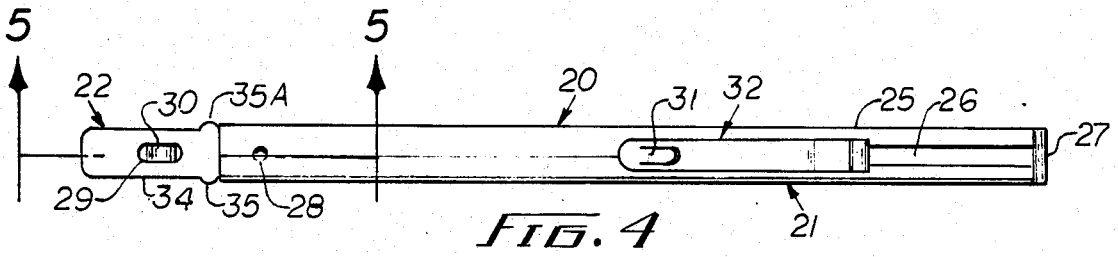
FIG. 4 is a plan view of the knife with the blade installed in a reversed storage position.

Referring first to FIGS. 1 to 3 inclusive showing a first embodiment of the invention, a knife, indicated generally at 20, has an elongated rectangular housing or handle, indicated generally as 21, made of stainless steel or a like material, provided with a longitudinal channel 26 and an elongated aperture 24 which is open in the normally upper face of the housing 21. At its normally forward end, the housing 21 is also provided with a small indentation that protrudes inwardly to form an internal nub 28.

Figure 5:
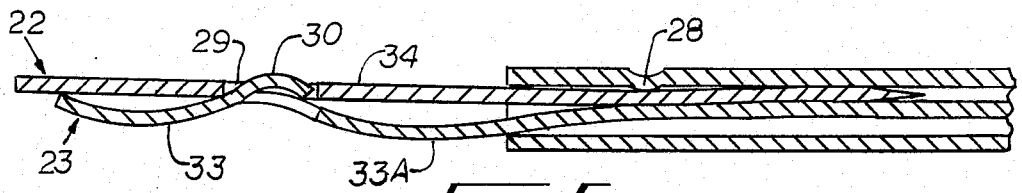
FIG. 5 is an enlarged sectional view taken along line 5—5 of FIG. 4.
Figure 6:
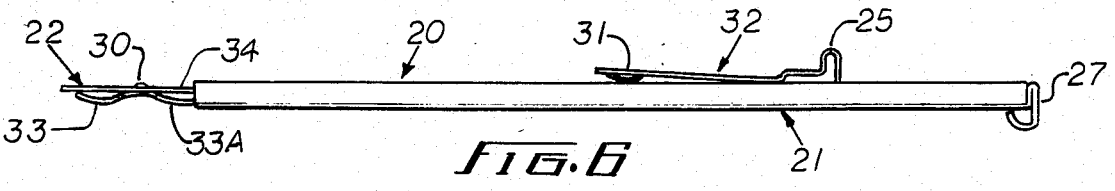
FIG. 6 is an elevational side view of FIG. 4 showing the blade in a reversed, storage position.

A slide or carrier, indicated generally as 23, is made of stainless spring steel, or a like material, and is adapted to slidably fit the housing 21 and channel 26. An end cap 27, unitarily formed from the handle housing 21, is held by a finger and the thumb in a manner to allow the thumb to push or pull knob 25. A pair of two longitudinal bends 33 and 33A (FIG. 2) and a centered tang 30 formed near the forward end of slide 23 are engageable with blade 22 and received by an aperture 29 in the blade 34. The slide 23 is fully extended to its forward blade-receiving position (FIG. 5) by pushing with the thumb on knob 25 and is stopped in its forward movement when knob 25 engages the forward end of the channel 26. When the slide 23 is at its maximum forward position, the blade shank 34 is placed over the two bends 33 and 33A with the centered tang 30 protruding through the blade's aperture 29. The blade shank 34, riding on the spring slide 23, is then pulled by a thumb on knob 25 to its detent position against the blade's shoulders 35 and 35A. The blade's shoulders 35 and 35A and aperture 29, in the blade's shank 34, have a coordinated measured stopping point under the inwardly protruding nub 28. FIG. 2 illustrates full blade detent, including the biasing deformed pressure of the bends 33 and 33A under the blade's shank 34. Added deformed pressure of the tang 30, under the rear portion of the nub 28, compresses the blade shank up and rearwardly to a coordinated detent against the blade's shoulders 35 and 35A. The dimensions, geometry and properties of the slide 23 are so selected as to allow the bends 33 and 33A and tang 30 to be easily deformed when pulled by a thumb on the knob 25 into the housing 34 and into its detent position.

FIGS. 4, 5, 6 and 8 illustrate the knife 20 with the cutting edge 37 of the blade reversed into the housing 21. To achieve this reverse storable position, the reversed blade 22 is placed on the fully extended slide 23 with the blade's shoulders 35 and 35A against the housing's 21 end and with the cutting edge 37 inside the housing 21. When installing the blade 22 on the slide 23, the tang 30 is guided to the blade's aperture 29 by self-centering shoulders 35 and 35A to positions engaging the end of the housing 21. Since the formed tang 30 is integral at its forward end to slide 23, it is functional as the blade's detent in its forward cutting position and, therefore, coordinates with the blade's aperture 29 and shoulders 35 and 35A in both detent positions.

A unitarily attached pocket clip, indicated generally as 32 (FIG.6), is provided with a formed tang 31 that is projected inwardly through the aperture 24 in the housing 21 when the blade 22 is installed in its cutting position. FIG. 1 illustrates, by way of a cut away view of the pocket clip 32, the underlying aperture 24. It is noted here that the tang 31, on the pocket clip 32, is projected inwardly into the receiving aperture 24, thus allowing the pocket clip 32 to be in a closed position and not receivable to a pocket edge at any intermediate points. The pocket clip 32 is only open to its pocket edge receivable position when the blade 22 is installed or when the slide 23 is at its extended position.

Figure 7:
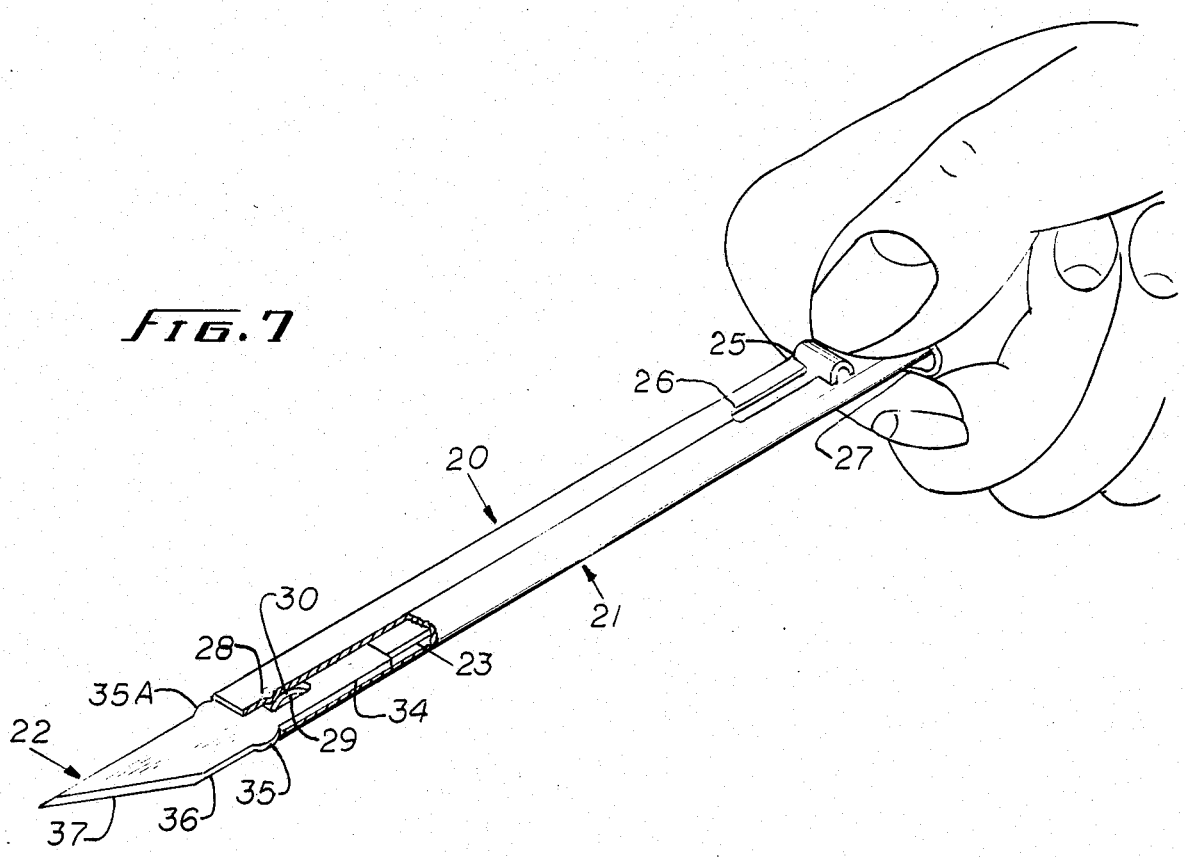
FIG. 7 is a perspective view of the knife with a part of the forward section of the knife handle cut away and in section.

Referring to FIG. 7, the blade 22 is removed from its secured cutting position by holding the end cap 27 with the forefinger and simultaneously pushing with the thumb on the knob 25.

Figure 8:
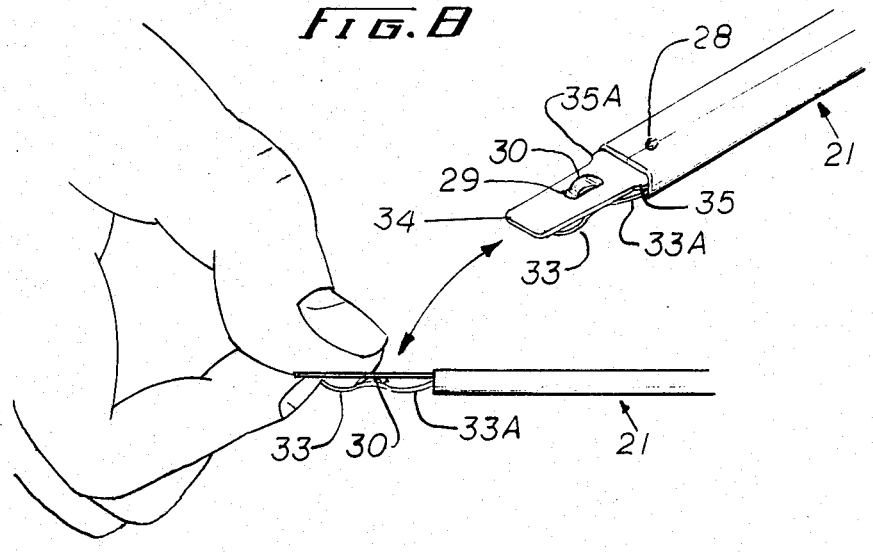
FIG. 8 is a perspective view showing how to reverse the blade in the knife handle.

Referring to FIG. 8, reverse blade 22 removal is made by pushing down on the tang 30 with the thumb while simultaneously pulling on the edge of the shank 34.

Figure 9:
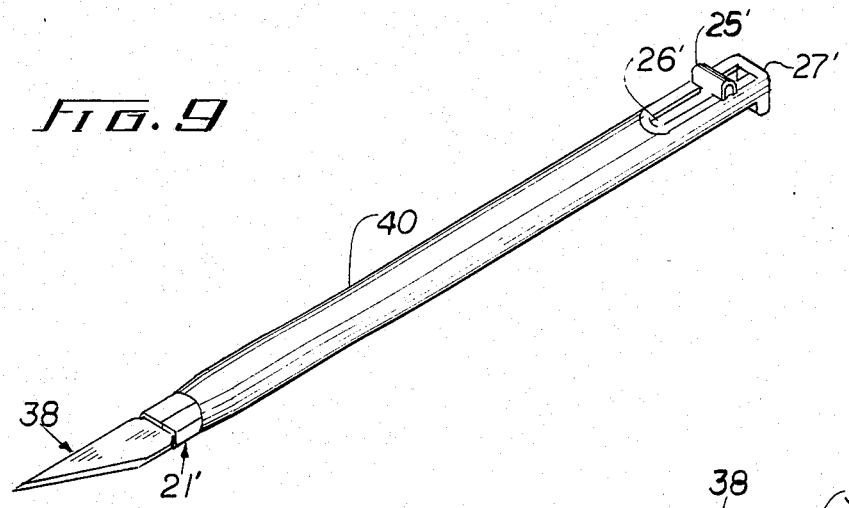
FIG. 9 is a perspective view of a second embodiment of the knife.
Figure 9:
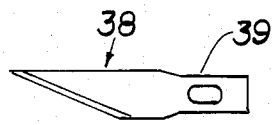
Figure 10:
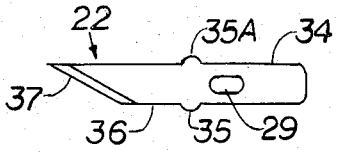
FIG. 10 shows a blade of the present invention in relation to a commercially available blade.

Referring to FIGS. 9 through 12, there is illustrated a modified second embodiment of a precision knife 20' which is similar, in most respects, to the precision knife 20 of FIGS. 1 through 8. Consequently, corresponding features of the two knives 20 and 20' bear the same references. The commercial blade shown in FIG. 10, illustrated generally at 38, is shown in comparison to the new reversible blade 22.

Figure 11:
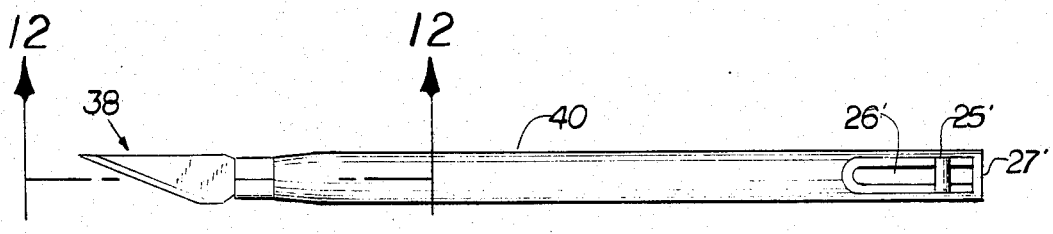
FIG. 11 is a plan view of the knife of FIG. 9.
Figure 12:
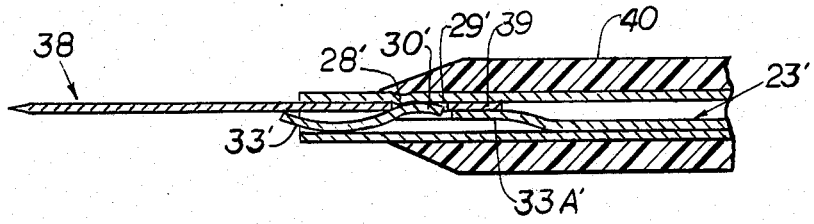
FIG. 12 is an enlarged sectional view taken along line 12—12 of FIG. 11.

The slide 23 is illustrated in FIG. 12 with a modified longitudinal bend 33A' and a centered tang 30' that accommodates the shorter shank 39 of the commercial blade 38. It is noted here that the modified version of slide 23 will also function in the first embodiment, however the bends, as described in the first embodiment are preferred therein for blade reversal stability. Also illustrated in FIGS. 9, 11 and 12 is a modification showing an optional injected molded plastic cylinder on the housing 21', making its circumference and length similar in size and shape to a popular commercial precision knife.

Although the invention has been described through its preferred forms, it is to be noted that the described embodiments are not exclusive and various changes and modifications may be imparted thereto without departing from the scope of the invention which is limited solely by the appended claims.

What is claimed is:

1. A knife comprising:

an elongated housing having a channel therethrough;

an elongated, resilient blade carrier slidably mounted in the channel for movement from a first position retracted in the housing to a second position partially extending out of the housing near said one end thereof, said carrier and the housing having cooperating means for releasably holding the carrier in said first position; and a blade removably attachable with the carrier when the latter is in said second position, said blade being movable partially into the channel with the carrier as the carrier moves from the second position to the first position, whereby the blade will be received within the channel, said cooperating means including a pair of spaced surfaces biased against the housing on one side of the channel and a third surface biased against the housing on the other side of the channel when the carrier is in said first position, whereby the blade will be biased against the housing and removably coupled with said housing.

2. A knife as set forth in claim 1, wherein said cooperating means includes a tang on the carrier and a nub on the housing, the tang defining said third surface, the nub extending into the channel for engagement with and defining a detent for the tang.

3. A knife as set forth in claim 2, wherein the shank of the blade has an aperture for receiving the tang for releasably connecting the blade to the carrier.

4. A knife as set forth in claim 3, wherein the blade has a pair of shoulders, intermediate to its end, for engaging the end of the housing when the carrier is in its said first position.

5. A knife as set forth in claim 1, wherein the carrier is of spring material and has a pair of bends therein defining said pair of surfaces and a centered tang defining the third surface.

6. A knife as set forth in claim 1, said blade having a blade body with a pair of laterally extending shoulder intermediate to the ends of the body, the portions of the blade body on opposite sides of the shoulders being substantially of the same width as said portions extend away from said shoulders, whereby the blade body can be reversibly mounted in one end of the carrier with the shoulders engaging said one end of the carrier.

7. A knife as set forth in claim 6, wherein the blade body has an aperture therethrough, said blade body adapted to be coupled with a blade carrier in said housing channel with the carrier having a tang and with the tang being removably received in the aperture of the blade body when said shoulders engage said end of the housing.

8. A knife as set forth in claim 7, wherein the portion of the blade body having the aperture defines a shank, the opposite portion of the blade body having a sharpened edge.

9. A knife comprising:

an elongated housing having a channel therethrough, said housing having a nub projecting into the channel near one end of the housing;

a blade carrier slidably mounted in the channel for movement from a first position retracted in the housing to a second position partially extending out of the housing near said one end thereof, said carrier and the housing having cooperating means for releasably holding the carrier in said first position, the carrier having a tang and a pair of bends on opposite sides of the tang, said nub releasably engageable with the tang when the carrier is in said first position, said bends being engageable with the inner surface of the housing to bias the carrier laterally as the carrier moves to said first position; and a blade having a shank, removably attachable with the carrier when the latter is in said second position, said blade being movable with the carrier as the carrier moves from the second position to the first position, whereby the shank will be received within the channel and the blade will be removably coupled with said housing.

10. A knife comprising:

an elongated housing having a channel therethrough, said housing having a nub projecting into the channel near one end of the housing;

a blade carrier slidably mounted in the channel for movement from a first position retracted in the housing to a second position partially extending out of the housing near said one end thereof, said carrier and the housing having cooperating means for releasably holding the carrier in said first position, the carrier having a knob on its opposite end, said housing having a slot for receiving the knob as the carrier moves between the first and second positions, said knob having a clip with a tang at its forward end that protrudes into the housing, the clip being biased against a surface of the housing when the carrier is in its first position, said tang being biased against a surface of the housing when the carrier is moved to its second position; and a blade having a shank, removably attachable with the carrier when the latter is in said second position, said blade being movable with the carrier as the carrier moves from the second position to the first position, whereby the shank will be received within the channel and the blade will be removably coupled with said housing.

11. A knife comprising:

an elongated housing having a channel therethrough, said housing having a nub projecting into the channel near one end of the housing;

a blade carrier slidably mounted in the channel for movement from a first position retracted in the housing to a second position partially extending out of the housing near said one end thereof, said carrier and the housing having cooperating means for releasably holding the carrier in said first position, said cooperating means including a tang on the carrier and said nub on the housing, the nub being engageable with the tang; and a blade having a shank, the shank of the blade having an aperture for receiving the tang for releasably connecting the blade to the carrier when the latter is in said second position, said blade being movable with the carrier as the carrier moves from the second position to the first position, whereby the shank will be received within the channel and the blade will be removably coupled with said housing, the knife blade having a pair of shoulders for engaging the end of the housing when the blade is reversed on the carrier and engageable therewith, the blade being removable from the carrier only by lifting the end of the blade shank or by pushing on the tang.

* * * * *